US010688789B2

(12) United States Patent
Cai et al.

(10) Patent No.: US 10,688,789 B2
(45) Date of Patent: Jun. 23, 2020

(54) INKJET PRINTING DEVICE

(71) Applicant: Wuhan China Star Optoelectronics Semiconductor Display Technology Co., Ltd., Wuhan, Hubei (CN)

(72) Inventors: Fenghao Cai, Guangdong (CN); Jeoung Kwen Noh, Guangdong (CN); Donghwan Kim, Guangdong (CN); Young Su Kim, Guangdong (CN); Chienlin Wu, Guangdong (CN); Xuwen Cao, Guangdong (CN)

(73) Assignee: WIHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 321 days.

(21) Appl. No.: 15/746,852

(22) PCT Filed: Dec. 5, 2017

(86) PCT No.: PCT/CN2017/114602
§ 371 (c)(1),
(2) Date: Jan. 23, 2018

(87) PCT Pub. No.: WO2019/000843
PCT Pub. Date: Jan. 3, 2019

(65) Prior Publication Data

US 2020/0079089 A1 Mar. 12, 2020

(30) Foreign Application Priority Data

Jun. 30, 2017 (CN) ..... 2017 2 0791275 U

(51) Int. Cl.
*B41J 2/165* (2006.01)
*B41J 2/175* (2006.01)
*B41J 2/18* (2006.01)

(52) U.S. Cl.
CPC ..... *B41J 2/165* (2013.01); *B41J 2/175* (2013.01); *B41J 2/17556* (2013.01); *B41J 2/18* (2013.01)

(58) Field of Classification Search
CPC ..... B41J 2/175; B41J 2/18; B41J 2/17556
See application file for complete search history.

(56) References Cited

U.S. PATENT DOCUMENTS 8,100,500 B2 * 1/2012 Bansyo ..... B41J 2/16532 347/19
8,186,819 B2 * 5/2012 Kaiho ..... B41J 29/38 347/85

(Continued)

*Primary Examiner* — John Zimmermann
(74) *Attorney, Agent, or Firm* — Hemisphere Law, PLLC; Zhigang Ma

(57) ABSTRACT

An inkjet printing device is provided. The second liquid storage tank is connected to a second buffer tank and the second buffer tank is pressurized so that the pressure at one side of the spray head near the second liquid storage tank is greater than the pressure at another side near the first liquid storage tank. As a result, the chemical solution in the spray head flows back into the first liquid storage tank or the liquid supply tank. Consequently, there is no residual chemical solution at the spray head so that the problem of the blocked spray head is not induced. Furthermore, by pressurizing the second buffer tank, the boiling point of the chemical solution can be reduced. The volatilization and solidification of the chemical solvent is reduced even further. Therefore, the problem of the blocked spray head is further mitigated. The quality of the chemical solution is ensured for a long time.

12 Claims, 1 Drawing Sheet

(56) References Cited

U.S. PATENT DOCUMENTS

| | | | | |
|---|---|---|---|---|
| 8,215,757 | B2 * | 7/2012 | Kuribayashi | B41J 2/19 347/85 |
| 8,235,494 | B2 * | 8/2012 | Kaiho | B41J 2/155 347/17 |
| 8,833,897 | B2 * | 9/2014 | Murata | B41J 2/16535 347/17 |
| 2009/0040249 | A1 * | 2/2009 | Wouters | B41J 2/1707 347/7 |
| 2009/0278887 | A1 * | 11/2009 | Iwasaki | B41J 2/1652 347/33 |
| 2010/0039486 | A1 * | 2/2010 | Wouters | B41J 2/175 347/92 |
| 2011/0279495 | A1 * | 11/2011 | Kuribayashi | B41J 2/18 347/6 |
| 2012/0188314 | A1 * | 7/2012 | Akiyama | B41J 2/175 347/85 |

* cited by examiner

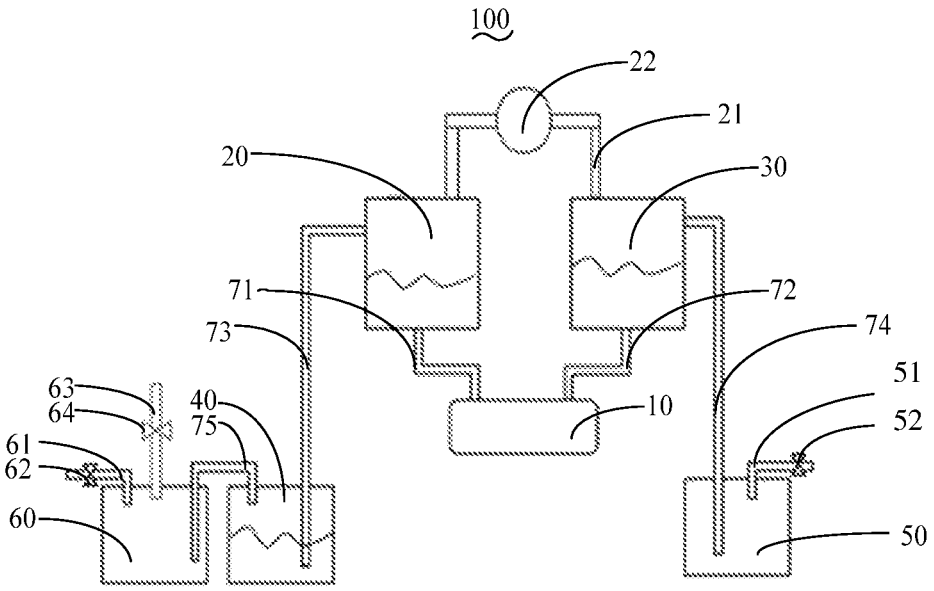
100
22
21
20
30
71
72
73
74
63
64
40
75
10
51
52
61
62
60
50

INKJET PRINTING DEVICE

RELATED APPLICATIONS

The disclosure is a National Phase of International Application Number PCT/CN2017/114602, filed on Dec. 5, 2017, and claims the priority of China Application No. 201720791275.0, filed on Jun. 30, 2017, the entirety of which is incorporated by reference herein.

FIELD OF THE DISCLOSURE

The disclosure relates to a technical field of inkjet printing, and more particularly to an inkjet printing device.

BACKGROUND

Inkjet printing technology is used in inkjet printers and has demonstrated its superior performance advantages in publishing printing and other fields. Now people try to use this technology for industrial production, for the fabrication of various thin film elements, including filters, orientation layers, PLED display panels, organic TFTs, etc.

One critical part of an inkjet printing device is a spray head. The chemical solution for printing is sprayed from nozzles of the spray head and is deposited on a substrate to fabricate various thin film elements. The nozzles generally have a smaller diameter (100 μm or less), and are small and numerous. In the process of inkjet printing, the problem of the blocked spray head, which is induced by volatilization and solidification of the chemical solvent on the spray head when the downtime is long, often occurs. Once the spray head is clogged, the spray head needs to be replaced, and thereby increasing the maintenance cost and maintenance time. At the same time, the volatilization of the chemical solvent results in changes in the viscosity of the chemical solution so that the chemical solution may fail.

SUMMARY

The disclosure provides an inkjet printing device. It achieves that the spray head is prevented from being blocked due to volatilization and solidification of chemical solvent when the inkjet printing device is stopped for a long time.

The inkjet printing device comprises a spray head, a liquid supply tank, a first liquid storage tank, a second liquid storage tank, a first buffer tank, and a second buffer tank. The spray head and the first liquid storage tank communicate with each other through a first pipeline. The spray head and the second liquid storage tank communicate with each other through a second pipeline. The first liquid storage tank and the liquid supply tank communicate with each other through a third pipeline. The liquid supply tank communicates with the first buffer tank through a fifth pipeline. The second liquid storage tank communicates with the second buffer tank through a fourth pipeline. The second buffer tank comprises a second connection pipe. The second buffer tank is pressurized through the second connection pipe so that the pressure in the second liquid storage tank is greater than the pressure in the first liquid storage tank.

Wherein the first buffer tank comprises a first connection pipe, and the first buffer tank is pressurized through the first connection pipe of the first buffer tank.

Wherein the first connection pipe and the second connection pipe are both provided with a valve.

Wherein the first connection pipe and the second connection pipe are individually connected with a gas supply element and respectively pressurize the first buffer tank and the second buffer tank through the gas supply element.

Wherein the first buffer tank further comprises an exhaust pipe.

Wherein the exhaust pipe is provided with a valve.

Wherein the first pipeline has one end connected to the spray head and another end connected to a bottom wall of the first liquid storage tank. The second pipeline has one end connected to the spray head and another end connected to a bottom wall of the second liquid storage tank.

Wherein one end of the third pipeline connected to the first liquid storage tank is close to a top wall of the first liquid storage tank. One end of the third pipeline connected to the liquid supply tank is close to a bottom wall of the liquid supply tank.

Wherein one end of the fifth pipeline connected to the liquid supply tank is close to a top wall of the liquid supply tank. One end of the fifth pipeline connected to the first buffer tank is close to a bottom wall of the first buffer tank.

Wherein one end of the fourth pipeline connected to the second liquid storage tank is close to a top wall of the second liquid storage tank. One end of the fourth pipeline connected to the second buffer tank is close to a bottom wall of the second buffer tank.

According to the inkjet printing device provided by the disclosure, the second buffer tank is pressurized such that the pressure in the second liquid storage tank connected to the second buffer tank is increased. As a result, the pressure at one side of the spray head near the second liquid storage tank is greater than the pressure at another side of the spray head near the first liquid storage tank. Therefore, the chemical solution in the spray head flows back into the first liquid storage tank or further flows back into the liquid supply tank connected to the first liquid storage tank. Consequently, there is no residual chemical solution at the spray head so that the problem of the blocked spray head, which is induced by the volatilization and solidification of the chemical solvent on the spray head, does not occur. Furthermore, by pressurizing the second buffer tank, the internal pressure of the inkjet printing device is increased such that the boiling point of the chemical solution can be reduced. The volatilization and solidification of the chemical solvent is reduced even further. Therefore, the problem of the blocked spray head is further mitigated. The quality of the chemical solution can be ensured for a long time. The fabrication cost is reduced, and the production efficiency is enhanced.

BRIEF DESCRIPTION OF THE DRAWINGS

In order to more clearly illustrate embodiments of the disclosure or technical solutions in the prior art, the accompanying drawings, which are used in the description of the embodiments or the prior art, will be briefly described. Apparently, the accompanying drawings in the description below are merely some embodiments of the disclosure. Other drawings can be obtained by a person of ordinary skill in the art according to these drawings without creative efforts.

FIG. 1 is a schematic structural diagram of an inkjet printing device of the disclosure.

DETAILED DESCRIPTION OF PREFERRED EMBODIMENTS

The technical solutions in the embodiments of the disclosure are clearly and completely described below with reference to the accompanying drawings in the embodiments of the disclosure. Apparently, the described embodiments are merely some but not all of the embodiments of the disclosure. All other embodiments obtained by a person of ordinary skill in the art based on the embodiments of the disclosure without creative efforts shall be included in the protection scope of the disclosure.

The disclosure provides an inkjet printing device. It can be used for fabricating various thin film elements, such as filters, orientation layers, PLED display panels, organic TFTs, etc.

Referring to FIG. 1, an inkjet printing device 100 is provided in the embodiment. The inkjet printing device 100 comprises a spray head 10, a first liquid storage tank 20, a second liquid storage tank 30, a liquid supply tank 40, a second buffer tank 50, and a first buffer tank 60. In which, the first liquid storage tank 20, the second liquid storage tank 30, the liquid supply tank 40, the second buffer tank 50, and the first buffer tank 60 are all hermetic tanks, and each includes a top wall, a bottom wall opposite to the top wall, and a sidewall connecting the top wall and the bottom wall.

The spray head 10 is used to spray chemical solution for printing to deposit on a substrate so as to fabricate various thin film elements.

The first liquid storage tank 20 is connected to the spray head 10 through a first pipeline 71. The second liquid storage tank 30 is connected to the spray head 10 through a second pipeline 72. The first liquid storage tank 20 and the second liquid storage tank 30 are both used to store the chemical solution for printing and respectively transfer the chemical solution to the spray head 10 through the first pipeline 71 and the second pipeline 72. Moreover, the first liquid storage tank 20 and the second liquid storage tank 30 are connected to each other by a pipeline 21. The pipeline 21 is provided with a pump 22 thereon. The circulation of the chemical solution in the first liquid storage tank 20 and the second liquid storage tank 30 is realized through the pump 22. As a result, the chemical solution is prevented from being deposited and so on, which would be induced due to the long storage time in the first liquid storage tank 20 or the second liquid storage tank 30. It is ensured that the chemical solution stored in the first liquid storage tank 20 or the second liquid storage tank 30 can be normally used. Furthermore, by circulating the chemical solution in the first liquid storage tank 20 or the second liquid storage tank 30, it can be ensured that the chemical solution in the first liquid storage tank 20 or the second liquid storage tank 30 has the same property. Therefore, it is guaranteed that the chemical solution sprayed through the spray head 10 has a stable property. A thin film element with a stable quality can be obtained.

In the embodiment, one end of the first pipeline 71 is connected to the spray head 10, and the other end of the first pipeline 71 is connected to the bottom wall of the first liquid storage tank 20 so as to realize sufficient use of the chemical solution stored in the first liquid storage tank 20. Similarly, one end of the second pipeline 72 is connected to the spray head 10, and the other end of the second pipeline 72 is connected to the bottom wall of the second liquid storage tank 30 so as to realize sufficient use of the chemical solution stored in the second liquid storage tank 30.

The liquid supply tank 40 is connected to the first liquid storage tank 20 through a third pipeline 73. The volume of the liquid supply tank 40 is larger than the volume of the first liquid storage tank 20. The chemical solution in the liquid supply tank 40 is pumped into the first liquid storage tank 20 through a pump and stored in the first liquid storage tank 20. As a result, the number of times that the chemical solution is extracted from the liquid supply tank 40 is reduced, and thereby reducing the cost and improving the efficiency of the inkjet printing. In the embodiment, one end of the third pipeline 73, which connects the liquid supply tank 40 and the first liquid storage tank 20, extends into the liquid supply tank 40 and is close to the bottom wall of the liquid supply tank 40. Accordingly, it is ensured that the chemical solution in the liquid supply tank 40 can be sufficiently used. One end of the third pipeline 73 connected to the first liquid storage tank 20 is close to the top wall of the first liquid storage tank 20.

The second buffer tank 50 is connected to the second liquid storage tank 30 through a fourth pipeline 74. When the chemical solution in the second liquid storage tank 30 overflows, the second buffer tank 50 is used for temporarily storing the chemical solution. When there is a remaining space in the second liquid storage tank 30, the chemical solution temporarily stored in the second buffer tank 5 can be stored in the second liquid storage tank 30 again by pressurizing the second buffer tank 5. In the embodiment, one end of the fourth pipeline 74 connected to the second liquid storage tank 30 is close to the top wall of the second liquid storage tank 30. As a result, when the chemical solution in the second liquid storage tank 30 is overfilled, the chemical solution is transferred into the second buffer tank 50 through the fourth pipeline 74. One end of the fourth pipeline 74 connected to the second buffer tank 50 is close to the bottom wall of the second buffer tank 50. As a result, the chemical solution is not easily splashed up when the chemical solution is transferred from the second liquid storage tank 30 into the second buffer tank 50.

In the embodiment, the second buffer tank 50 further comprises a second connection pipe 51. The second connection pipe 51 is provided with a valve 52 thereon. The valve 52 is a normally-closed valve. The second connection pipe 51 is connected to a gas supply element. When the inkjet printing device 100 stops working, the valve 52 is opened. The second buffer tank 50 is pressurized through the gas supply element so as to increase the pressure in the second liquid storage tank 30. As a result, the pressure in the second liquid storage tank 30 is greater than the pressure in the first liquid storage tank 20. That is, the pressure at one side of the spray head 10 near the second liquid storage tank 30 is greater than the pressure at another side near the first liquid storage tank 20. Accordingly, the chemical solution in the second liquid storage tank 30 and the chemical solution in the spray head 10 flow back into the first liquid storage tank 20. Alternatively, the chemical solution in the second liquid storage tank 30, the chemical solution in the spray head 10, and the chemical solution in first liquid storage tank 20 all flow back into the liquid supply tank 40. Therefore, there is no residual chemical solution at the spray head 10. Even if the inkjet printing device 100 does not operate for a long period of time, the problem of the blocked spray head, which is induced by the volatilization and solidification of the residual chemical solvent at the spray head 10, does not occur. Furthermore, the internal pressure of the inkjet printing device 100 can be increased, and thereby reducing the boiling point of the chemical solution in the inkjet printing device 100. As a result, the volatilization and solidification of the chemical solvent is reduced even further. Therefore, the problem of the blocked spray head is further mitigated. The quality of the chemical solution can be maintained for a long time. After the pressurization in the second buffer tank 50 is completed, the valve 52 on the second connection pipe 51 is closed.

The first buffer tank 60 is connected to the liquid supply tank 40 through a fifth pipeline 75. When the chemical solution in the liquid supply tank 40 overflows, the first buffer tank 60 is used for temporarily storing the chemical solution. When there is a remaining space in the liquid supply tank 40, the chemical solution temporarily stored in the first buffer tank 60 can be stored in the liquid supply tank 40 again by pressurizing the first buffer tank 60. In the embodiment, one end of the fifth pipeline 75 connected to the liquid supply tank 40 is close to the top wall of the liquid supply tank 40. As a result, when the chemical solution in the liquid supply tank 40 is overfilled, the chemical solution is transferred into the first buffer tank 60 through the fifth pipeline 75. One end of the fifth pipeline 75 connected to the first buffer tank 60 is close to the bottom wall of the first buffer tank 60. As a result, the chemical solution is not easily splashed up when the chemical solution is transferred from the liquid supply tank 40 into the first buffer tank 60.

In the embodiment, the first buffer tank 60 further comprises a first connection pipe 61 and an exhaust pipe 63. The first connection pipe 61 is provided with a valve 62. The exhaust pipe 63 is provided with a valve 64. The valve 62 and the valve 64 are normally-closed valves. The first connection pipe 61 is connected to a gas supply element. When the inkjet printing device 100 is stopped for a long time, the valve 62 on the first connection pipe 61 is opened. The first buffer tank 60 is pressurized through the gas supply element so as to increase the pressure in the inkjet printing device 100. As a result, the boiling point of the chemical solution is reduced even further, and thereby reducing the volatilization and solidification of the chemical solvent. Therefore, the problem of the blocked spray head is mitigated. The quality of the chemical solution can be maintained for a long time. After the pressurization in the first buffer tank 60 is completed, the valve 62 on the first connection pipe 61 is closed. However, the pressure increased in the first buffer tank 60 through the first connection pipe 61 is less than the pressure increased in the second buffer tank 50 through the second connection pipe 51. Accordingly, it is ensured that the pressure at one side of the spray head 10 near the second liquid storage tank 30 is greater than the pressure at another side near the first liquid storage tank 20. It is ensured that the residual chemical solution in the spray head 10 can return back into the first liquid storage tank 20 or the liquid supply tank 40. When the inkjet printing device 100 is required to be used again, the valve 64 on the exhaust pipe 63 is opened to keep the air pressure of the inkjet printing device 100 to be the same as the external air pressure. The inkjet printing device 100 is then turned on.

According to the inkjet printing device 100 provided by the disclosure, the second buffer tank 50 is pressurized such that the pressure in the second liquid storage tank 30 connected to the second buffer tank 50 is increased. As a result, the pressure at one side of the spray head 10 near the second liquid storage tank 30 is greater than the pressure at another side near the first liquid storage tank 20. Therefore, the chemical solution in the spray head 10 flows back into the first liquid storage tank 20 or further flows back into the liquid supply tank 40 connected to the first liquid storage tank 20. Consequently, there is no residual chemical solution at the spray head so that the problem of the blocked spray head, which is induced by the volatilization and solidification of the chemical solvent on the spray head 10, does not occur. Furthermore, by pressurizing the second buffer tank 50 or simultaneously pressurizing the second buffer tank 50 and the first buffer tank 60, the internal pressure of the inkjet printing device 100 is increased. As a result, the boiling point of the chemical solution in the inkjet printing device 100 can be reduced. The volatilization and solidification of the chemical solvent is reduced even further. Therefore, the problem of blocking the spray head 10 is further mitigated. The quality of the chemical solution can be ensured for a long time. The fabrication cost is reduced, and the production efficiency is enhanced.

The foregoing descriptions are merely preferred embodiments of the disclosure. The protection scope of the disclosure is certainly not limited to these descriptions. A person of ordinary skill in the art can understand that all or part of the processes for implementing the foregoing embodiments and equivalent changes made according to the disclosure should be included in the protection scope of the application.

What is claimed is:

1. An inkjet printing device, comprising:

a spray head, a liquid supply tank, a first liquid storage tank, a second liquid storage tank, a first buffer tank, and a second buffer tank, wherein the spray head and the first liquid storage tank communicate with each other through a first pipeline, the spray head and the second liquid storage tank communicate with each other through a second pipeline, the first liquid storage tank and the liquid supply tank communicate with each other through a third pipeline, the liquid supply tank communicates with the first buffer tank through a fifth pipeline, the second liquid storage tank communicates with the second buffer tank through a fourth pipeline, the second buffer tank comprises a second connection pipe, and the second buffer tank is pressurized through the second connection pipe so that a pressure in the second liquid storage tank is greater than a pressure in the first liquid storage tank to make a chemical solution in the spray head to flow back into the first liquid storage tank or the liquid supply tank to remove a residue of the chemical solution at the spray head when the inkjet printing device stops printing.

2. The inkjet printing device as claimed in claim 1, wherein the first buffer tank comprises a first connection pipe, and the first buffer tank is pressurized through the first connection pipe of the first buffer tank.

3. The inkjet printing device as claimed in claim 2, wherein the first connection pipe and the second connection pipe are both provided with a valve.

4. The inkjet printing device as claimed in claim 2, wherein the first connection pipe and the second connection pipe are individually connected with a gas supply element and respectively pressurize the first buffer tank and the second buffer tank through the gas supply element.

5. The inkjet printing device as claimed in claim 2, wherein the first buffer tank further comprises an exhaust pipe.

6. The inkjet printing device as claimed in claim 5, wherein the exhaust pipe is provided with a valve.

7. The inkjet printing device as claimed in claim 1, wherein the first pipeline has one end connected to the spray head and an another end connected to a bottom wall of the first liquid storage tank, and wherein the second pipeline has one end connected to the spray head and an another end connected to a bottom wall of the second liquid storage tank.

8. The inkjet printing device as claimed in claim 7, wherein one end of the third pipeline connected to the first liquid storage tank is close to a top wall of the first liquid storage tank, and wherein one end of the third pipeline connected to the liquid supply tank is close to a bottom wall of the liquid supply tank.

9. The inkjet printing device as claimed in claim 8, wherein one end of the fifth pipeline connected to the liquid supply tank is close to a top wall of the liquid supply tank, and wherein one end of the fifth pipeline connected to the first buffer tank is close to a bottom wall of the first buffer tank.

10. The inkjet printing device as claimed in claim 9, wherein one end of the fourth pipeline connected to the second liquid storage tank is close to a top wall of the second liquid storage tank, and wherein one end of the fourth pipeline connected to the second buffer tank is close to a bottom wall of the second buffer tank.

11. The inkjet printing device as claimed in claim 1, wherein the first buffer tank further comprises an exhaust pipe.

12. The inkjet printing device as claimed in claim 11, wherein the exhaust pipe is provided with a valve.

* * * * *